United States Patent [19]

Cass

[11] Patent Number: 4,998,705

[45] Date of Patent: Mar. 12, 1991

[54] APPARATUS FOR FORMING VOIDS IN CONCRETE

[76] Inventor: Ronald L. Cass, 4329 Glenwood Ave., Ft. Myers, Fla. 33905

[21] Appl. No.: 385,403

[22] Filed: Jul. 27, 1989

[51] Int. Cl.[5] ..... E04G 15/06

[52] U.S. Cl. ..... 249/177; 249/39; 249/43; 249/63; 249/153; 249/179; 249/183

[58] Field of Search ..... 249/39, 43, 177, 183, 249/63, 64, 66.1, 150, 153, 179, 182

[56] References Cited

U.S. PATENT DOCUMENTS

| | | | |
|---|---|---|---|
| 2,234,784 | 3/1941 | Stolz | 249/183 |
| 2,698,855 | 1/1961 | Stolz | 249/183 |
| 3,414,951 | 12/1968 | Schulze | 249/183 |
| 4,427,173 | 1/1984 | MacKay | 249/39 |

FOREIGN PATENT DOCUMENTS

| | | | |
|---|---|---|---|
| 910699 | 11/1962 | United Kingdom | 249/183 |

*Primary Examiner*—James C. Housel

*Attorney, Agent, or Firm*—Fleit, Jacobson, Cohn, Price, Holman & Stern

[57] ABSTRACT

An apparatus for forming voids in concrete which includes baseplates secured to a wood supporting deck or form for a concrete floor by a plurality of removable screws and a removalbe sleeve attached to each baseplate and having a height generally equal to the thickness of the floor with the upper end of the sleeve being accessible and observable when concrete is poured. After the baseplates have been secured in place, various subsequent work procedures may be carried out without the workers encountering obstructions that would exist if upwardly projecting cavity forming members were attached to the wood deck. A sleeve is then attached to each baseplate immediately prior to pouring concrete. After the concrete has been poured and set, the sleeves are detached from the baseplates and removed. The wood deck can then be stripped from the bottom of the concrete floor and the baseplates removed for reuse.

6 Claims, 1 Drawing Sheet

APPARATUS FOR FORMING VOIDS IN CONCRETE

BACKGROUND OF THE INVENTION

1. Field of the Invention

The present invention generally relates to the construction of concrete floors or other concrete bodies and more specifically an apparatus for forming voids in concrete and the method of using the apparatus. The apparatus includes baseplates secured to a wood supporting deck or form for a concrete floor by a plurality of removable screws in a location determined by the plans of the concrete floor which usually requires the formation of various voids, cavities, openings or holes in the floor and a removable sleeve attached to each baseplate and having a height generally equal to the thickness of the floor with the upper end of the sleeve being accessible and observable when concrete is poured. In using the apparatus, the baseplates are affixed to the wood deck in accordance with the plans for the floor after the wood deck has been placed in position to receive poured concrete After the baseplates have been secured in place, various subsequent work procedures may be carried out without the workers encountering obstructions that would exist if upwardly projecting cavity forming members were attached to the wood deck. Such work procedures include the positioning of reinforcing bars, cables and the like which have a tendency to dislodge and damage any upward projections on the wood deck. After all work procedures have been performed on the wood deck, including positioning of rebars, a sleeve is attached to each baseplate immediately prior to pouring concrete thereby eliminating the problem of upwardly projecting cavity forming members on the wood deck being displaced or damaged during work procedures prior to pouring concrete. After the concrete has been poured and set, the sleeves are detached from the baseplates and removed. The wood deck can then be stripped from the bottom of the concrete floor with the baseplates still attached thereto. The baseplates are then removed from the wood deck panels and the baseplates and sleeves are capable of reuse. In other situations, the baseplates can be detached from the wood deck before the wood deck is stripped by using a long screwdriver to remove the screws after which the baseplate can be lifted out of the cavity. If a "flying form" is used, the baseplates can remain attached to the deck.

2. Information Disclosure Statement

In present day building structures, it is necessary to form voids or openings in concrete floors when the floors are poured. The openings in concrete floors are necessary to receive cables, wiring, plumbing and the like which is installed in the building after all of the concrete floors have been formed. Various efforts have been made to form the voids or openings including the provision of sleeve structures and the like that are attached to the wood deck onto which the concrete floor is to be poured with these sleeve members projecting upwardly from the wood deck thereby forming obstructions to workers who are performing various work procedures on the wood deck including workers that are positioning rebars. It frequently occurs that the upwardly projecting sleeves are damaged or displaced during various work procedures and the upwardly projecting sleeves also form obstructions over which workers can trip and fall with resultant injury. The following disclose various structures endeavoring to provide voids or openings in a concrete floor:

U.S. Pat. No. Re 31,598
U.S. Pat. No. 762,194
U.S. Pat. No. 1,391,988
U.S. Pat. No. 1,746,696
U.S. Pat. No. 2,249,824
U.S. Pat. No. 2,694,847

While such prior art devices are related to the formation of voids or cavities in a concrete deck, none of them utilize the specific structure and method of this invention since none of those patents disclose baseplates secured to a wood deck prior to placement of rebars thereon with the sleeves being attached to the baseplates just prior to pouring concrete with the sleeves being removed from the upper surface of the set concrete after which the wood deck is separated from the concrete floor and the baseplates removed from the deck after the deck has been removed from the bottom surface of the set concrete thereby enabling reuse of the baseplates and sleeves. Tapering of sleeves provides a cavity that is larger at the top than at the bottom thereby making it easier to fill the cavity with fireproof materials to the required levels.

SUMMARY OF THE INVENTION

An object of the present invention is to provide an apparatus for forming openings in a concrete floor or other concrete body in which the apparatus includes recoverable and reusable components as well as a unique method of using the apparatus to more effectively and accurately form openings through a concrete floor or other concrete body.

Another object of the invention is to provide an apparatus in accordance with the preceding object in which the apparatus includes baseplates secured to a wood deck for a concrete floor or a form member which supports and engages a concrete mixture or other hardenable mixture which is placed on the wood deck or form member prior to work procedures being performed in adjacent relation to the baseplates and subsequently placing a sleeve on each baseplate and connecting it thereto immediately prior to pouring the concrete mixture or similar pourable and hardenable material against the wood deck or form member with the sleeves being removable after the concrete mixture or other hardenable mixture has set or hardened with the baseplates being removed from the wood deck or form member before or after separation from the hardened floor or concrete body thereby enabling reuse of the baseplates and sleeves.

A further object of the invention is to provide an apparatus and method as set forth in the preceding objects in which each baseplate is secured to the wood deck or form member by conventional screws and the sleeve is secured to the baseplate in enclosing relation thereto by a rod or bolt having screw threaded components associated with the baseplate and sleeve to secure the sleeve fixedly to the baseplate and to move the sleeve away from the baseplate to facilitate extraction of the sleeve from the concrete floor or body after it hardens.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
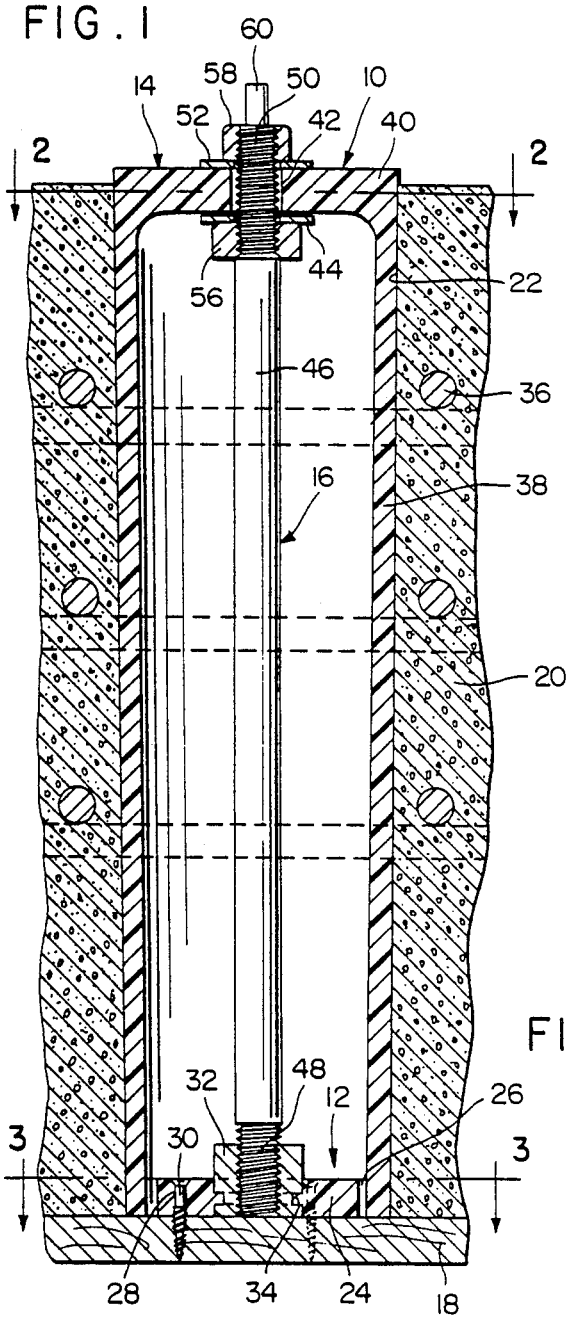
FIG. 1 is a sectional view of the apparatus of the present invention in assembled relation with a concrete floor and rebars associated therewith.
Figure 2:
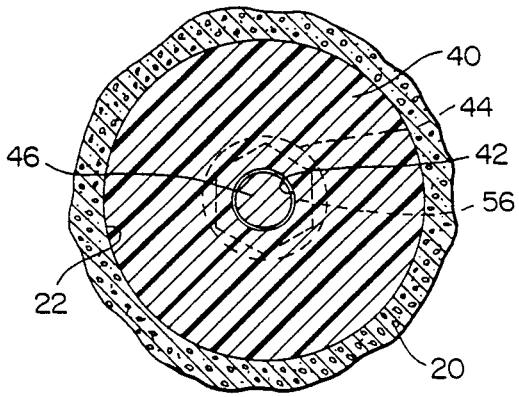
FIG. 2 is a transverse, sectional view, on an enlarged scale, taken substantially upon a plane passing along section line 2—2 on FIG. 1.

Referring now specifically to the drawings, the apparatus for forming voids or cavities in a concrete floor or other concrete body is generally designated by reference numeral 10 and includes a baseplate 12, a tubular sleeve 14 and a sleeve retaining bolt or rod 16 with these components being associated with a wood floor deck 18 which is a form member that supports and engages concrete 20 such as a concrete floor when it is poured when forming a building structure. The wood floor deck 18 conventionally employed for this purpose is constructed from plywood panels supported by a suitable framing structure. When forming concrete floors, it is necessary to provide voids, cavities or openings 22 therethrough to receive cables, wiring, plumbing and the like which is installed after the concrete floor has been constructed.

When a concrete floor is to be poured, the wood deck 18 is assembled in a manner to form a substantially planar upper surface that is horizontally disposed. In conventional practice, a plurality of upwardly projecting void or opening forming members are attached to the wooden deck in accordance with the plans for the floor. Various work procedures are then performed by workers who find it necessary to walk along the surface of the wood deck and the upwardly projecting members form obstructions which can impede a worker's progress and, in some instances, trip the worker and cause the worker to fall. Also, when installing rebars, it frequently occurs that the rebars contact the upwardly projecting members and displace them from the desired position or, in some instances, bend or deform the opening defining members and the upwardly projecting members form an obstruction to location and movement of the rebars when laying them in desired position and anchoring them in that position. In many instances, the upwardly projecting members become a permanent part of the concrete floor since they are attached to the wood deck with nails which hold the upwardly projecting members in place but still enable the wooden deck to be separated from the bottom surface of the concrete floor after it hardens. If the conventional upwardly extending member is displaced, tilted, bent or punctured, the void or cavity will be lost thus necessitating the floor to be core drilled in order to form the void. If post tensioned cable is used in the floor, it is necessary to use an expensive X-ray procedure to avoid damage to the cables.

Figure 4:
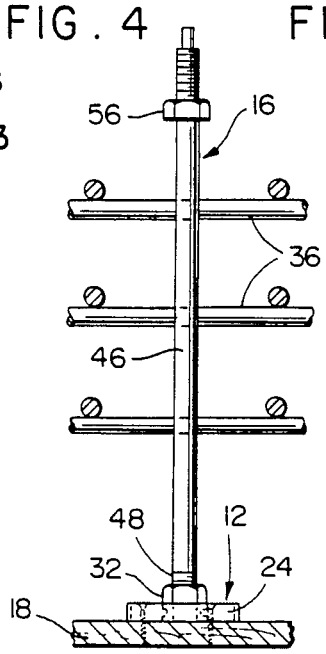
FIG. 4 is a schematic, elevational view illustrating the initial arrangement of the baseplate on the wood deck and illustrating the manner in which rebars can be assembled without interference from upward projections on the wood deck.

In the present invention, the baseplate 12 is in the form of a circular plate 24 constructed of plastic material or the like that is provided with a plurality of locating notches 26 in the periphery thereof which are aligned with chalk lines for proper positioning. The plate 24 also is provided with three equally spaced apertures 28 receiving fastener screws 30 which secure the plastic baseplate or mounting plate 24 to the wood deck 18 with the heads of the screws 30 being countersunk into the top surface of the plate 24. Embedded in and rigidly secured to the plate 24 is a metallic nut 32 which may be in the form of a hex nut that is internally threaded and provided with an external groove 34 which anchors the nut 32 in the plastic baseplate 24 when the baseplate and nut are injection molded together or formed by sonic welding or other conventional techniques. Thus, the baseplate 12 which includes the plastic plate 24 and the hexagonal nut 32 of aluminum or other metallic material is easily attached to the wood deck 18 by using the screws 30 and the thickness of the baseplate 12 is such that it will not produce upwardly extending projections that have a height generally equal to the thickness of the concrete floor. Rather, the projection is very shallow and will enable workers to traverse the wood floor when mounted thereon. The short height of the baseplate also enables the reinforcing bars 36 to be oriented in desired relation, usually in a grid pattern as illustrated in FIG. 4 which shows the baseplate 12 secured to the wood deck 18 and also shows the next step in the operation in which the rebars 36 have been positioned in their desired relationship.

Figure 3:
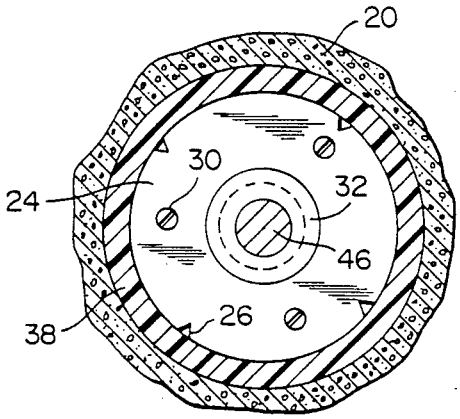
FIG. 3 is a transverse, sectional view, on an enlarged scale, taken substantially upon a plane passing along section line 3—3 on FIG. 1 illustrating the structure of the baseplate.
Figure 5:
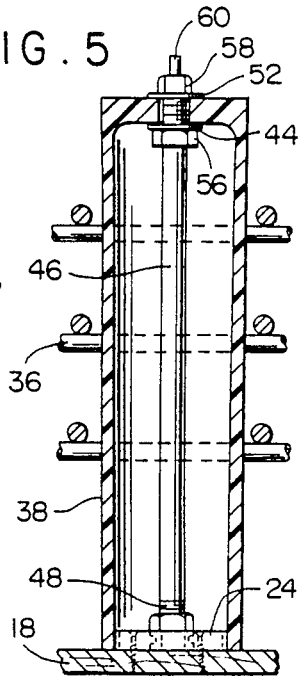
FIG. 5 is a schematic, sectional view illustrating assembly of the sleeve with the baseplate immediately prior to pouring concrete.
Figure 6:
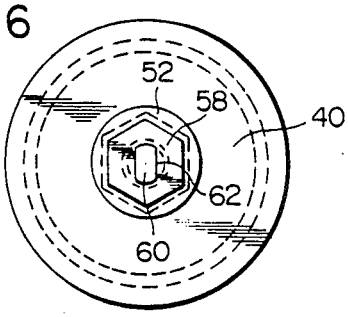
FIG. 6 is a top plan view of the sleeve and retaining rod or bolt.

The sleeve 14 is mounted on the baseplate 12 and includes a generally cylindrical plastic wall 38 and a plastic circular top wall 40 of unitary construction with the cylindrical wall 38. The bottom end of the wall 38 is open and closely telescopes over the periphery of the baseplate 12 as illustrated in FIGS. 1, 3 and 5 and tightly contacts deck 18. The generally cylindrical wall 38 is provided with a draft in the form of a 1° taper from top to bottom with the bottom being smaller to facilitate extraction from the void 22 in the concrete floor 20 when it is desired to remove the sleeve 14 from the cavity to form a void or opening 22. The sleeve 14 is secured to the baseplate 12 by the retaining bolt or rod 16 which includes an elongated rod 46 having an externally threaded lower end 48 screw threaded into the hex nut 32 and an externally threaded upper end 50 extending through an opening or hole 42 in the top wall 40 of the sleeve 14. Mounted on the inner or lower end of the threaded upper end 50 is an internally threaded nut 56 which is screw threaded onto the threaded portion 50 all the way to the lower end thereof and which cooperates with a washer 44 to facilitate extraction of the sleeve 14 in a manner described hereinafter. Threaded onto the top end of the threaded upper end 50 is an internally threaded nut 58 which engages a washer 52 in contact with the upper surface of the top wall 40 of the sleeve 14 to hold the lower end against the wooden deck 18. The upper end of the bolt or rod above the upper end 50 is provided with a polygonal projection 60 that has opposing flat surfaces 62 to enable a wrench to be engaged therewith for rotating the bolt or rod 16 during assembly and disassembly of the sleeve 14 and bolt or rod 16 in relation to the baseplate 12. The elongated rod 46 also can be reattached to the baseplate 12 after the sleeve 14 has been removed to enable the baseplate 12 to be removed through the cavity 22 after the screws 30 have been removed but prior to stripping the wooden deck 18.

After the baseplates 12 have been assembled onto the wood deck 18 and all work procedures, including positioning of the rebars 36, has been completed, a sleeve 14 is assembled onto each baseplate immediately prior to pouring concrete. This is accomplished by first threading the lower threaded end 48 of the rod or bolt 46 into the nut 32 resulting in the arrangement illustrated in FIG. 4. The sleeve 14 is then positioned over the bolt or rod 46 and slid down over the rod 46 until the lower end of the wall 38 engages the upper surface of the floor deck 18 with the dimensional characteristics of these components being such that the nut 56 will be spaced below the top wall 40 a relatively short distance. The nut 58 is then positioned on the threaded end 50 of the rod 46 along with washer 52 to secure the sleeve 14 tightly against the deck 18. After this assembly has been completed, the concrete is then poured onto the floor deck 18 to an elevation completely enclosing all of the rebars 36. The vertical height of the sleeve 14 is such that the top wall 40 will be spaced slightly above the upper surface 62 of the concrete floor 20. After the concrete floor has set or hardened, a wrench is engaged with the flattened surfaces 62 on the extension 60 and the rod 46 is rotated in a manner to unscrew it from the nut 32. In some instances, the nut 58 may be loosened or removed prior to rotating the bolt or rod 46. In any event, rotation of the rod or bolt 46 will cause the washer 44 and nut 56 to move upwardly to contact the undersurface of top wall 40 so that continued rotation of the bolt 46 will cause the bolt to move upwardly thus exerting an upward thrust on the sleeve 14 thereby extracting the sleeve from the concrete floor 20 thus leaving a void, cavity or opening 22 completely through the concrete floor. As is conventional, after the concrete floor has set for a predetermined period of time, the wood floor deck 18 is separated from the bottom surface of the concrete floor 20. After the wooden deck has been separated, the baseplates 12 can be removed by removing the screws 30 thereby providing reusable baseplates 12 and reusable sleeves 14 and rods or bolts 16 for use in forming voids or openings in other concrete floors or other concrete floor areas. Alternatively, the baseplates 12 may be removed through the voids 22 prior to stripping the deck 18 by removing screws 30 and using the rod 46 to lift the baseplates 12 from the voids 22.

With this arrangement of apparatus and the method as defined, the entire apparatus is reusable and is attached to the wood deck and separated therefrom by the use of only three screws. The components may be constructed in various sizes depending upon installation requirements. Assembly of the sleeves onto the baseplates that have been installed when the deck is laid out from the floor plans enables all work procedures to be performed without encountering vertically elongated obstructions thus greatly facilitating the effective completion of various work procedures including the installation of rebars. The sleeve and baseplate being constructed of plastic material provides a structure that is much stronger than presently used items and enables the device to be easily cleaned and is less hazardous to use as well as being easy to assemble and disassemble. The sleeve 14 and the bolt or rod 16 can be assembled in relation to each other and left in assembled condition by leaving the nut 58 on the screw threaded upper end 50 of the bolt or rod 46 thereby even further reducing the number of loose components encountered when installing the sleeve 14 in relation to the baseplate 12.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. An apparatus for forming an opening through a hardenable material which hardens while in contact with at least one form member, said apparatus comprising a baseplate, means detachably mounting the baseplate on the form member, an opening forming member, and means detachably mounting said opening forming member on said baseplate, said opening forming member projecting from said baseplate and form member and having a length to extend completely through the hardenable material to form an opening therein when removed after the material has hardened, said baseplate mounting means enabling removal from the form member when the member is separated from the hardenable material after hardening thereby enabling reuse of the baseplate and opening forming member, said opening forming member including a tubular sleeve having a peripheral wall, an end wall at one end of the peripheral wall, with the other end of the peripheral wall being open for engagement with the form member and baseplate, said means detachably mounting said opening forming member to said baseplate including an elongated retaining bolt having one end threadedly engaged with the baseplate and the other end extending through an opening in the end wall of the sleeve to retain the sleeve in place, said bolt including means exerting force on the sleeve to remove the sleeve from the hardenable material when the bolt is unscrewed from the baseplate.

2. The structure as defined in claim 1 wherein said sleeve is cylindrical and said baseplate is a circular plate, said sleeve and plate being constructed of plastic material with the baseplate including an internally threaded nut rigidly fixed to said plate.

3. The structure as defined in claim 2 wherein said means detachably mounting the baseplate on the form member includes a plurality of screws extending through the baseplate into the form member.

4. The structure as defined in claim 3 wherein said hardenable material is a concrete floor and the form member is a wood deck supporting the concrete floor when it is poured for hardening, said means securing the baseplate to the form member extending into the wood deck prior to positioning rebars and concrete, said sleeve being secured to the baseplate after positioning rebars and immediately prior to pouring concrete with the end wall of the sleeve being positioned above the top surface of the concrete when the concrete is poured and hardened.

5. An apparatus for forming voids in a hardenable material, said apparatus comprising a baseplate, means securing the baseplate to the surface of a form member for the hardenable material, a tubular sleeve engaging the form member and telescoped over the baseplate, means engaging said sleeve and said baseplate for releasably securing said sleeve to said baseplate, said means securing the sleeve to the baseplate being accessible for actuation externally of the sleeve, said means securing the sleeve to the baseplate including means exerting a force on the sleeve to extract said sleeve from the hardenable material when the securing means for the sleeve is disengaged from the baseplate.

6. The apparatus as defined in claim 5 wherein said means securing the sleeve to the baseplate includes an elongated rod, screw threaded means connecting the rod to the baseplate, said sleeve including an end wall remote from the baseplate, said end wall on the sleeve including an aperture receiving said rod therethrough, said rod including means on an end thereof for moving the rod rotationally to unscrew said rod from the baseplate, said rod including means thereon engaging the end wall on the sleeve for exerting a force thereon to move said sleeve away from the baseplate when the rod is unscrewed from the baseplate.

* * * * *